US008194507B2

(12) United States Patent
Mills

(10) Patent No.: US 8,194,507 B2
(45) Date of Patent: Jun. 5, 2012

(54) HIDDEN DISPLAY AND CLOCK AUDIO APPARATUS INCLUDING SAME

(75) Inventor: Stephen B. Mills, Atkinson, NH (US)

(73) Assignee: Brookstone Purchasing, Inc., Merrimack, NH (US)

( * ) Notice: Subject to any disclaimer, the term of this patent is extended or adjusted under 35 U.S.C. 154(b) by 855 days.

(21) Appl. No.: 12/206,614

(22) Filed: Sep. 8, 2008

(65) Prior Publication Data

US 2010/0061048 A1 Mar. 11, 2010

(51) Int. Cl.
*G04C 19/00* (2006.01)
*G04C 17/00* (2006.01)
*G09G 3/06* (2006.01)

(52) U.S. Cl. ..... 368/83; 368/223; 368/241; 345/32; 345/44

(58) Field of Classification Search ..... 368/82–84, 368/239–241, 223; 40/219, 447; 345/30, 345/32, 34, 82, 44; 349/62, 63, 112; 362/494, 362/623
See application file for complete search history.

(56) References Cited

U.S. PATENT DOCUMENTS 2,132,476 A * 10/1938 En Holm ..... 40/219
4,202,607 A * 5/1980 Washizuka et al. ..... 349/113
4,271,492 A * 6/1981 Battista ..... 368/10
4,630,904 A * 12/1986 Pastore ..... 359/636
4,747,086 A * 5/1988 Shaw ..... 368/239
4,922,384 A * 5/1990 Torrence ..... 362/611
5,210,967 A * 5/1993 Brown ..... 40/219
5,575,552 A * 11/1996 Faloon et al. ..... 362/492
5,734,627 A 3/1998 Sy
5,926,440 A * 7/1999 Chien ..... 368/10
5,987,793 A * 11/1999 Ebine ..... 40/580
6,172,613 B1 * 1/2001 DeLine et al. ..... 340/815.4
6,329,925 B1 * 12/2001 Skiver et al. ..... 340/815.4
6,996,031 B1 * 2/2006 Cripe ..... 368/10
7,287,737 B2 * 10/2007 Rossi ..... 248/475.1
7,397,461 B1 * 7/2008 Graham ..... 345/156
7,805,260 B2 * 9/2010 Mischel et al. ..... 702/44
2007/0081423 A1 * 4/2007 Chien ..... 368/67
2007/0159316 A1 * 7/2007 Mischel et al. ..... 340/461
2009/0102748 A1 * 4/2009 Stoyer et al. ..... 345/33

* cited by examiner

*Primary Examiner* — Vit Miska
(74) *Attorney, Agent, or Firm* — Grossman Tucker Perreault & Pfleger, PLLC

(57) ABSTRACT

A hidden display may be used in an apparatus to display information to a user. The display hardware is generally hidden within the apparatus and illuminated information appears on an outside surface of the apparatus to display the information. The hidden display may couple light into a display panel from the inside of the apparatus to provide the illuminated information on the outside surface of the display panel. The display panel may provide diffuse reflection of ambient light on the outside of the display panel such that the display hardware is not visible behind the display panel but without providing a mirror-like reflection. The display may be used in a variety of different apparatuses or devices including, but not limited to, clocks and clock audio devices.

20 Claims, 6 Drawing Sheets

HIDDEN DISPLAY AND CLOCK AUDIO APPARATUS INCLUDING SAME

TECHNICAL FIELD

The present invention relates to displays and more particularly, to a hidden display and apparatuses, such as a clock audio apparatus, that include such hidden displays.

BACKGROUND INFORMATION

Various devices use displays to provide information regarding the operation of the device. Clocks and clock radios are examples of devices that include displays to display information such as a time or radio station. Such devices may include light emitting diodes (LEDs) to provide an illuminated display of numbers, letters, words and/or other symbols. On many of these devices, the display includes a transparent glass or plastic panel. With such a transparent panel, the underlying display elements are visible to the user even when the display is not turned on or illuminated. Also, such transparent panels may cause an undesirable glare or reflection.

Some attempts have been made to hide displays, for example, behind a one-way mirror. In such devices, however, the display may not always provide adequate and consistent illumination through the mirror due to certain manufacturing challenges. For example, slight variances in an inside coating of the mirror or in the planarity of the inside surface may adversely affect the quality of the display through the mirror. Also, the specular reflection on the outside of the mirror may be undesirable for displays used on certain types of devices.

BRIEF DESCRIPTION OF THE DRAWINGS

These and other features and advantages will be better understood by reading the following detailed description, taken together with the drawings wherein.

DETAILED DESCRIPTION

A hidden display, consistent with embodiments described herein, may be used in an apparatus to display information to a user. The display hardware is generally hidden within the apparatus and illuminated information appears on an outside surface of the apparatus to display the information. The hidden display may couple light into a display panel from the inside of the apparatus to provide the illuminated information on the outside surface of the display panel. The display panel may provide diffuse reflection of ambient light on the outside of the display panel such that the display hardware is not visible behind the display panel but without providing a mirror-like reflection. The display may be used in a variety of different apparatuses or devices including, but not limited to, clocks and clock audio devices.

As used herein, "couple" or "coupled" may refer to mechanical, optical and/or electrical coupling and do not imply a direct coupling or connection unless otherwise specified. As used herein, "optically coupled" refers to at least one coupled element being adapted to impart light to another coupled element directly or indirectly. As used herein, "reflect" or "reflection" refers to the redirection of at least a portion of incident radiation and does not require reflection of all radiation nor does it require reflection at any particular angle. As used herein, "diffuse reflection" refers to the reflection of light at a number of different angles.

Figure 1:
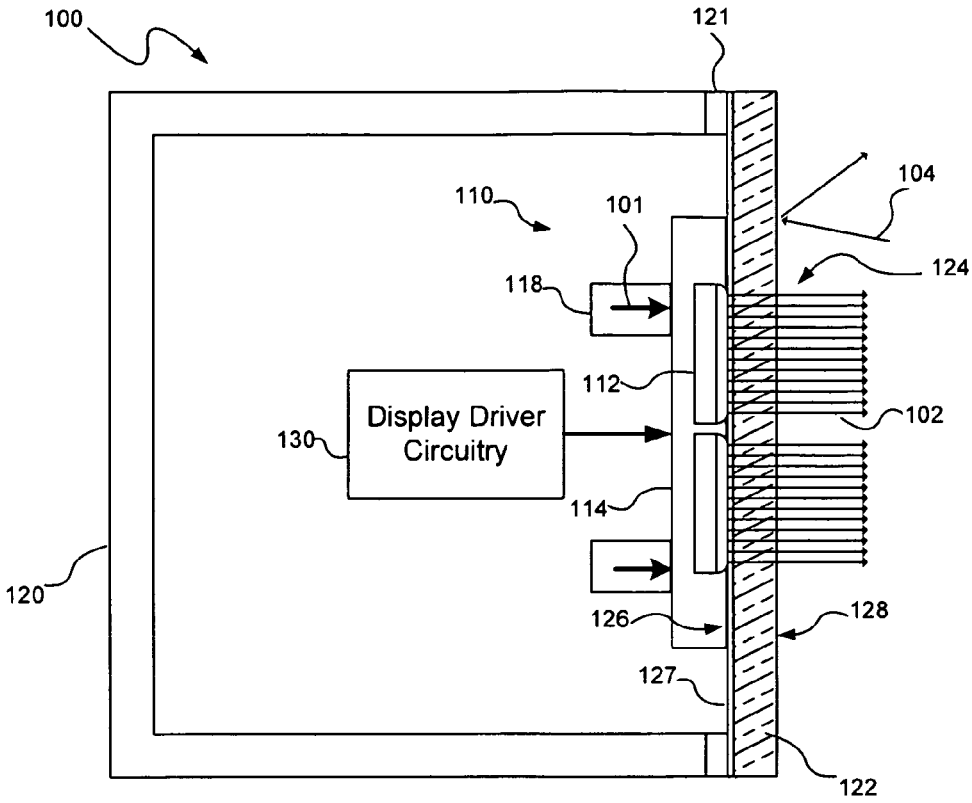
FIG. 1 is a side schematic view of a hidden display, consistent with an embodiment.

Referring to FIG. 1, a hidden display 110 may be used in an apparatus 100 to display information to a user. The apparatus 100 may include a housing 120 that houses the hidden display 110 and display driver circuitry 130 that controls operation of the display 110. As will be described in greater detail below, the light 102 generated by the hidden display 110 is visible from outside of the apparatus 100 but the display hardware inside the apparatus 100 is not visible from outside of the apparatus 100. Although the hidden display 110 is shown in an apparatus 100 having an enclosed housing 120 of a particular shape, the hidden display 110 may also be used in housings of other types and shapes.

The hidden display 110 generally includes one or more light emitting display elements 112 that emit light 102 and optically couple the light 102 into a display panel 122. The display panel 122 both hides the light emitting display element(s) 112 and provides a display region 124 that is illuminated by the light emitting display element(s) 112 to form illuminated information. The display panel 122 includes an inside surface 126 in contact with the light emitting display element(s) 112 and an outside surface 128 including the display region 124. The light emitting display element(s) 112 may contact the inner surface 126 of the display panel 122 directly or indirectly (e.g., through another element or layer that allows light to pass through).

The display panel 122 is transparent to the light 102 impinging on the inside surface 126 and allows the light 102 to pass through. The light 102 is thus visible in the display region 124 on the outside surface 128 of the display panel 122. The display panel 122 is also opaque to ambient light 104 that impinges on the outside surface 128 such that the display hardware (e.g., light emitting elements 112) is not visible behind the display panel 122 when viewed by the naked eye in ambient light. In an embodiment, the display panel 122 may provide diffuse reflection of the ambient light 104 such that a substantial portion of the ambient light 104 is reflected without creating a mirror-like effect.

According to an embodiment, the display panel 122 may be constructed similar to a two-way mirror (also referred to as a one-way mirror or one-way glass), which is partially transparent to allow light to pass through from the inside of the display panel 122 and partially reflective to provide diffuse reflection of ambient light from the outside of the display panel 122. One way to create such a two-way mirror effect is by using a transparent substrate coated on the inside surface 126 with a partially reflective layer 127 such as, for example, a very thin almost transparent layer of metal.

According to one example, the display panel 122 may include a polycarbonate substrate that is powder coated on the inside surface 126 to provide the layer 127 having the partially transparent and partially reflective properties. The powder coating may be applied using materials and techniques known to those skilled in the art. According to one technique, for example, a flash coating of copper may be applied to the inside surface of the polycarbonate substrate. The copper flash coating may be positively charged, sprayed with a negatively charged powder coating material, and cured in ultraviolet light. The powder coating material may be a UV curable powder coating resin with a pigment providing the desired color (e.g., metallic gray). The resulting powder coating formed on the inside surface 126 of the display panel 122 allows the light 102 from the light emitting display elements 112 to pass through from the inside but causes ambient light to be reflected from the outside of the display panel 122.

The transparent substrate (e.g., polycarbonate) may be given a textured finish on the outside surface 128 (and edges), which provides the diffuse reflection of ambient light. The display panel 122 may also be made of other transparent materials known to those skilled in the art such as acrylic or acrylonitrile butadiene styrene (ABS), and other types of coatings that will create the two-way mirror effect.

The light emitting display element(s) 112 may be carried by a display element carriage 114 that is held in contact with the display panel 122. The hidden display 110 may also include a spring biasing mechanism 118 that biases the display element carriage 114 and the light emitting display element(s) 112 into contact with the inside surface 126 of the display panel 122. The spring biasing mechanism 118 allows the display element carriage 114 to move when the display panel 122 is secured to the housing 120 and applies a force (e.g., in the direction of line 101) against the display element carriage 114 to hold the light emitting element(s) 112 into contact with the display panel 112. The spring biasing mechanism 118 may include compression springs (e.g., coil springs, cantilever springs or leaf springs), foam rubber, and/or any other element capable of allowing movement of and applying force to the display element carriage 114 and/or light emitting element(s) 112. Holding the light emitting display element(s) 112 into contact with the inside surface 126 of the display panel 122 facilitates the coupling of light 102 into the display panel 122 and results in a more consistent illumination and display even with slight variances in the coating 127 and/or planarity of the inside surface 126 of the display panel 122. In other words, the characters or symbols may be displayed in the display region 124 with less blurring and with a higher readability The light emitting display element(s) 112 may include one or more light emitting diodes (LEDs) that emit the light 102. In one embodiment, for example, the light emitting display elements 112 may include a segmented LED display, such as a seven segment LED display, to display alpha-numeric characters. The display driver circuitry 130 may include circuitry generally known to those skilled in the art for controlling the light emitting display element(s) 112 to create the illumination that forms the displayed information. Where the light emitting display elements 112 include a segmented LED display, for example, the display driver circuitry 130 includes circuitry known to those skilled in the art for causing the appropriate LED segments to be illuminated to form characters representing the displayed information.

In the illustrated embodiment, the display panel 122 forms a side of the housing 120 of the apparatus 100, although the display panel 122 may also be separate from the housing 120 or may form only a portion of a side of the housing 120. A seal 121 may be provided between the display panel 122 and the other sides of the housing 120 to prevent leakage of light between the display panel 122 and housing 120. Minimizing light leakage into or out of the housing 120 may also improve the sharpness and readability of the characters or symbols displayed in the display region 124. In some embodiments, however, a relatively small amount of light may exit a top edge of the display panel 122 to create a glowing effect. The other sides of the housing 120 may also be formed similar to the display panel 122, for example, by powder coating polycarbonate. One or more additional displays may also be provided on other sides of the housing 120 of the apparatus 100.

Figure 2A:
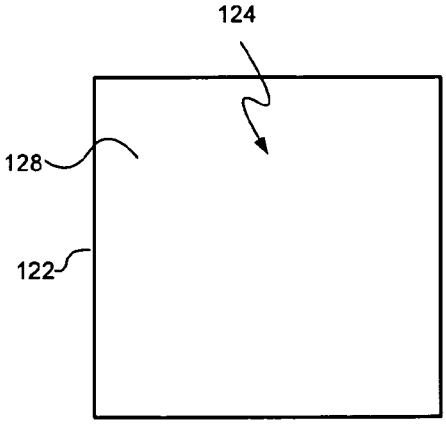
FIGS. 2A and 2B are front views of a hidden display in an off state and an on state, respectively, consistent with an embodiment.
Figure 2B:
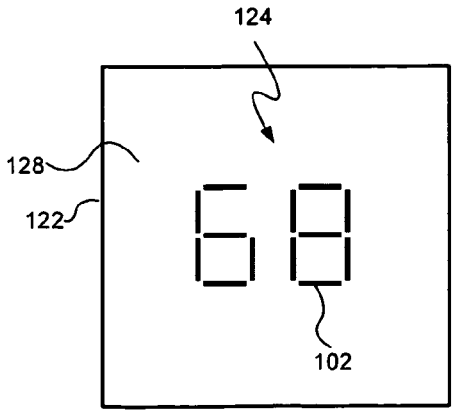

Referring to FIGS. 2A and 2B, the hidden display 110 is shown, respectively, in an "off" or non-illuminated state and in an "on" or illuminated state. In the "off" or non-illuminated state (FIG. 2A), the display hardware (e.g., the light illuminating device(s) 112 and display element carriage 114 shown in FIG. 1) is not visible on the outside surface 128 of the display panel 122. For example, the display region 124 may be undistinguishable from the other regions of the display panel 122 and thus give the appearance of a continuous homogeneous surface. In other words, the information can be displayed on the housing 120 itself rather than requiring an interruption or discontinuity of a separate display panel portion on the exterior of the apparatus 100. In the "on" or illuminated state (FIG. 2B), the light 102 emitted by the light emitting display elements 112 hidden behind the display panel 122 appears on the outside surface 128 in the display region 124.

Figure 3:
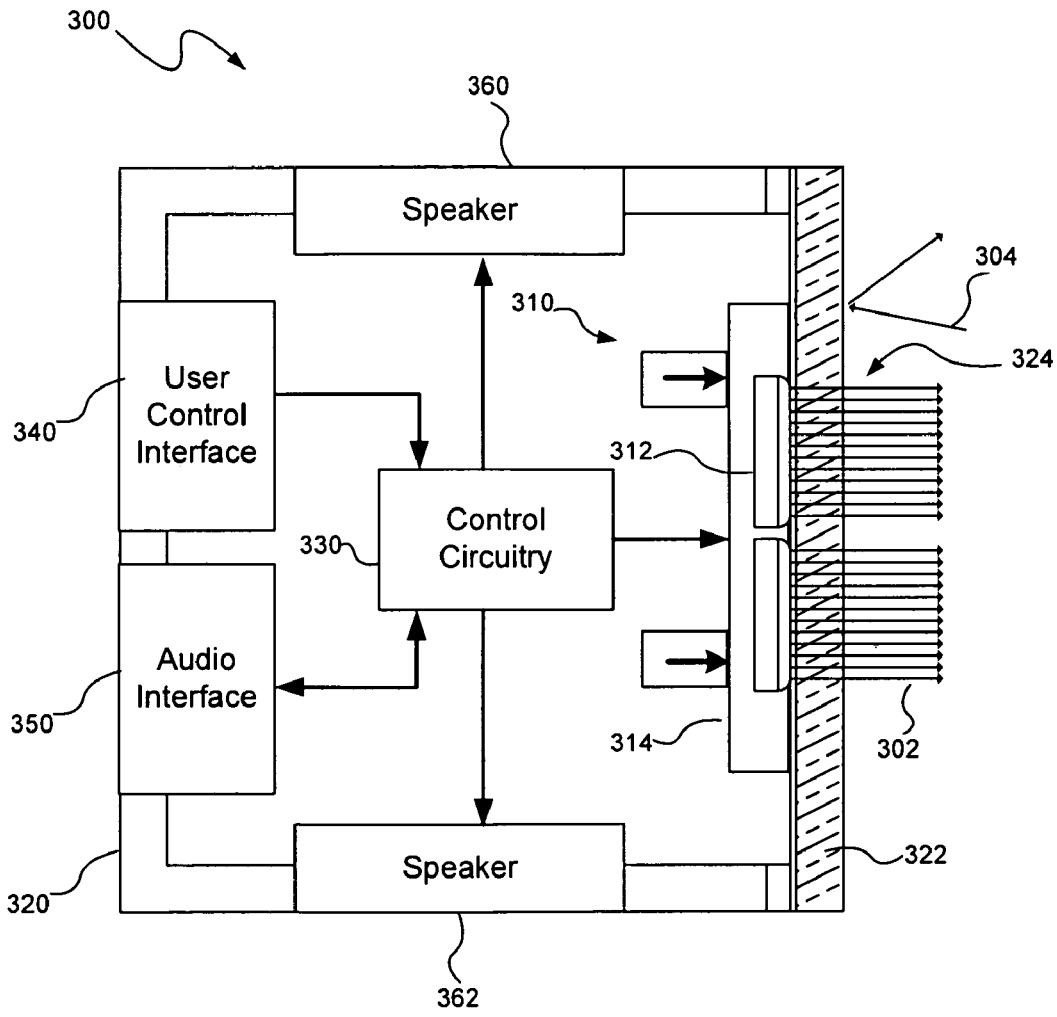
FIG. 3 is a side schematic view of a clock audio apparatus including a hidden display, consistent with another embodiment.
Figure 5:
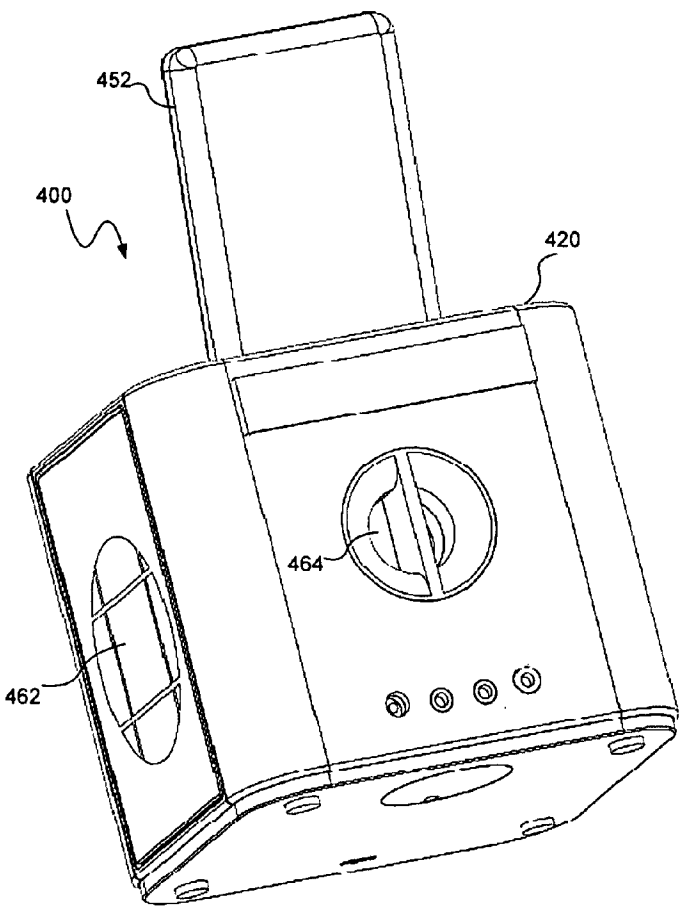
FIG. 5 is a rear perspective view of the clock audio apparatus shown in FIG. 4.

Referring to FIG. 3, one type of apparatus that may include a hidden display 310 is a clock audio apparatus 300 such as a clock radio. As described above, the clock audio apparatus 300 may include the hidden display 310 within a housing 320 and hidden behind a display panel 322. The hidden display 310 may include one or more light emitting display elements 312 that couple light 302 into the display panel 322 to form illuminated information on a display region 324 of the display panel 322. The display panel 322 may be opaque to ambient light 304 such that the display hardware (e.g., light emitting elements 312) is not visible behind the display panel 322 when viewed by the naked eye in ambient light.

The clock audio apparatus 300 may also include control circuitry 330, a user control interface 340, an audio interface 350, and one or more speakers 360, 362 at least partially enclosed within the housing 320. The control circuitry 330 may include circuitry known to those skilled in the art for controlling the display functions, the clock functions and the audio functions. The user control interface 340 may include any type of interface that a user may use to interact with the clock audio apparatus 300 including, but not limited to, buttons and switches used to control the display, clock and audio functions. The audio interface 350 may include any type of interface that is capable of receiving analog or digital signals representing audio including, but not limited to, a radio antenna, a CD player, or a digital media player interface (e.g., an IPOD® dock with connector). The speakers 360, 362 may include any type of speaker capable of converting audio signals to sound. In the clock audio apparatus 300, the hidden display 310 may display clock information (e.g., time of day, alarm time, and alarm mode) and audio information (e.g., radio station, track number, and volume) in the display region 324.

Referring to FIGS. 4-10, an embodiment of a clock audio apparatus 400 including a hidden display 410 is described in greater detail. The exemplary clock audio apparatus 400 includes alarm clock functions (e.g., time of day display, alarm, and snooze features) and audio functions (e.g., radio and digital media player connectivity). An embodiment of the clock audio apparatus 400 includes a housing 420 that houses the hidden display 410, control circuitry 430, 432, 434, user interface controls 440, 442, 444, 446, digital media player interface components 450, 454, and speaker components 460, 462, 464.

Figure 4:
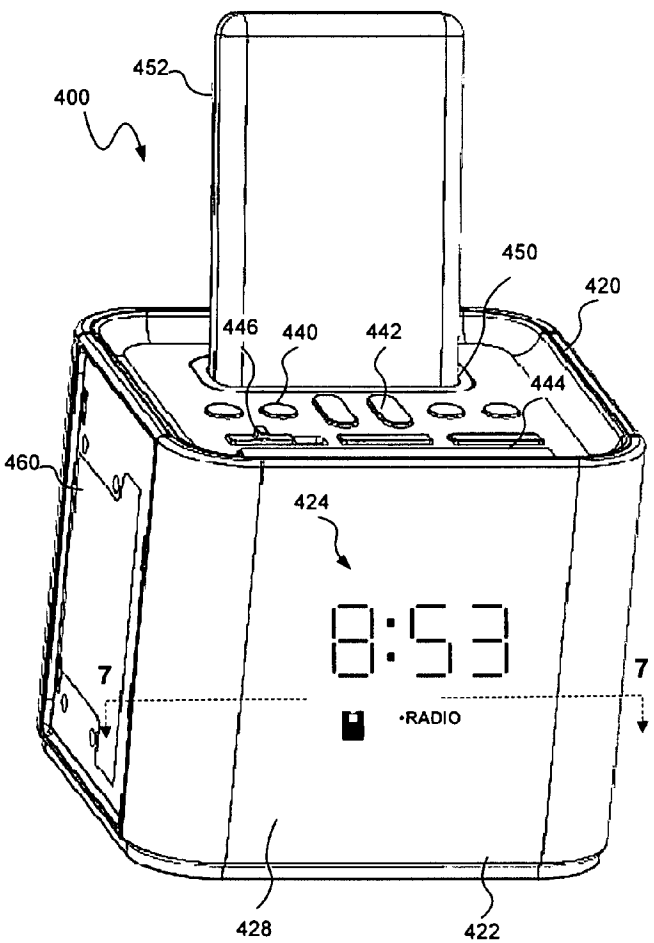
FIG. 4 is a front perspective view of a clock audio apparatus including a hidden display, consistent with a further embodiment.
Figure 6:
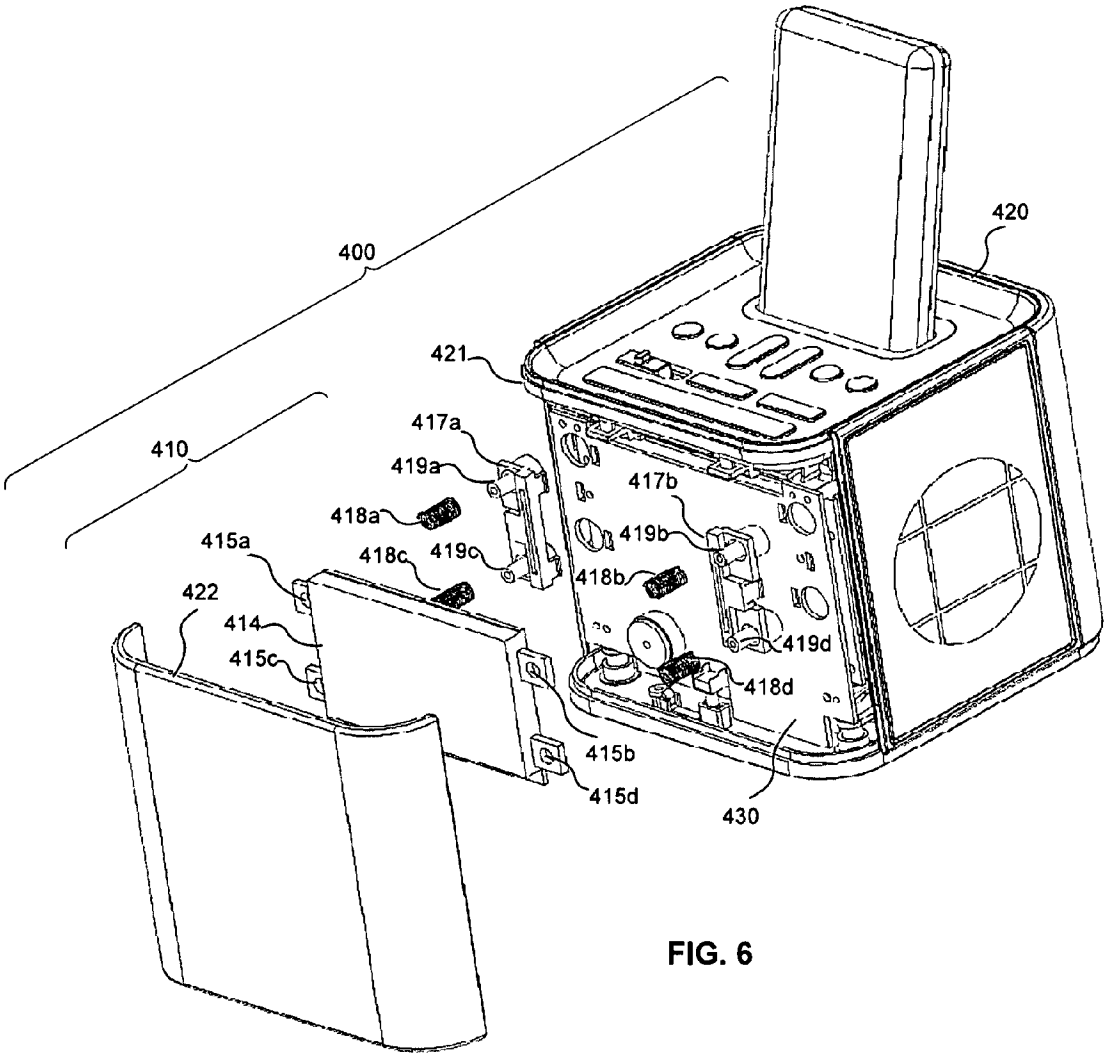
FIG. 6 is an exploded perspective view of the clock audio apparatus shown in FIG. 4.

As shown in FIG. 4, the clock audio apparatus 400 generally includes a display panel 422 on the front side of the housing 420. In the illustrated embodiment, the display panel 422 is also the front panel of the housing 420. As disclosed above, the display panel 422 may be a powder-coated polycarbonate with a metallic gray color. A seal 421 may be provided at the interface between the display panel 422 and the housing 420 to prevent leakage of light (see FIGS. 6 and 10). The display panel 422 provides a display region 424 on an outside surface 428 for displaying illuminated information, such as a time of day, alarm setting symbols, volume, and audio input information.

The hidden display 410 is shown in greater detail in FIGS. 6-9. In this embodiment, the hidden display 410 includes LED display element carriage 414 held in contact with an inside surface 426 of the display panel 422 by compression springs 418*a*-418*d* (see FIG. 7). The LED display element carriage 414 may include LEDs 412 that emit light to form the illumination on the outside surface 428 of the display panel 422. The LEDs 412 may include, for example, LEDs forming a segmented display used to form alpha-numeric characters and LEDs that illuminate other words or symbols used to provide information such as audio input and alarm setting information (see FIG. 9). Other types and configurations of light emitting display elements may also be used.

Figure 8:
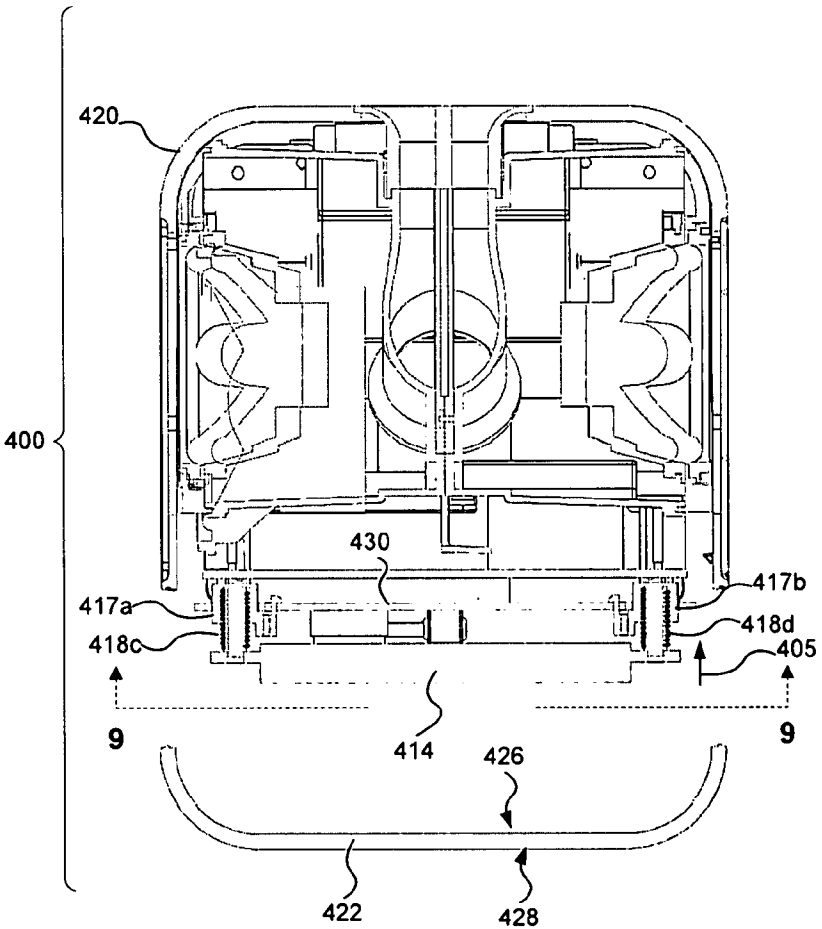
FIG. 8 is an exploded top cross-sectional view of the clock audio apparatus shown in FIG. 7 with a front display panel removed.
Figure 7:
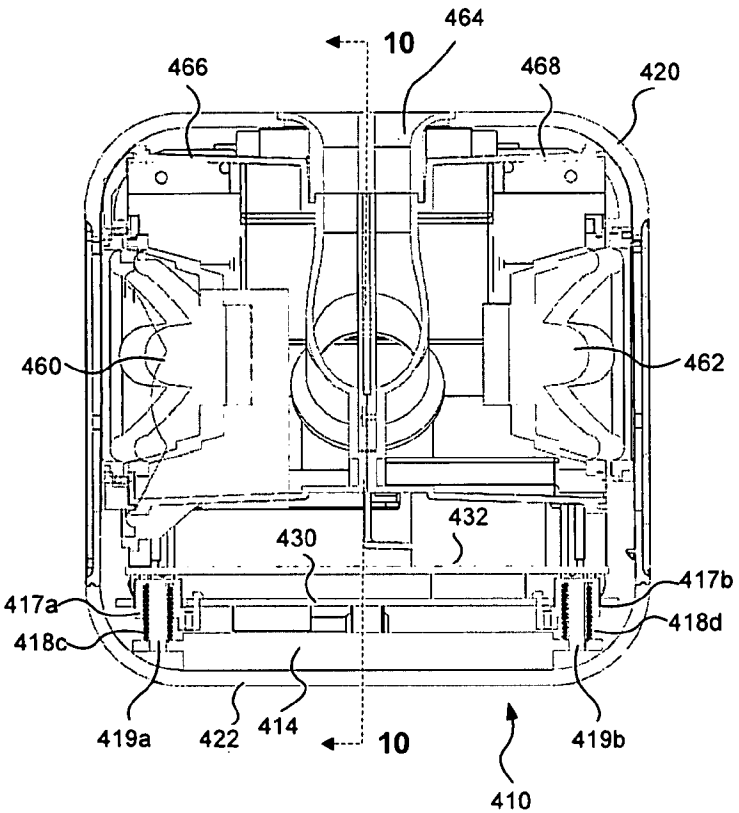
FIG. 7 is top cross-sectional view of the clock audio apparatus taken along line 7-7 in FIG. 4.
Figure 10:
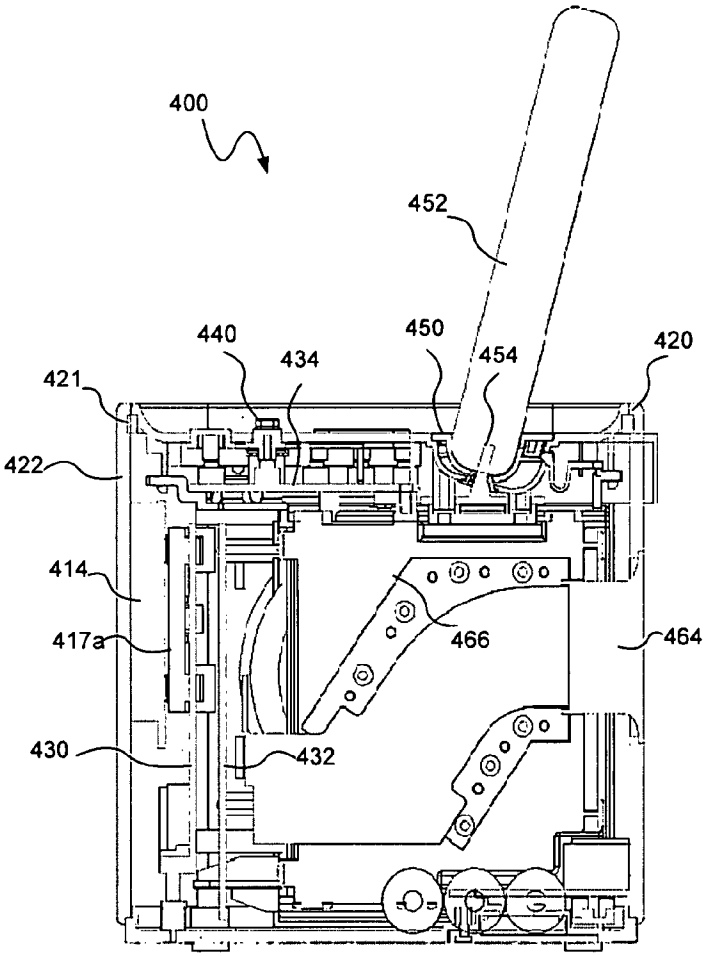
FIG. 10 is side cross-sectional view of the clock audio apparatus taken along line 10-10 in FIG. 7.
Figure 9:
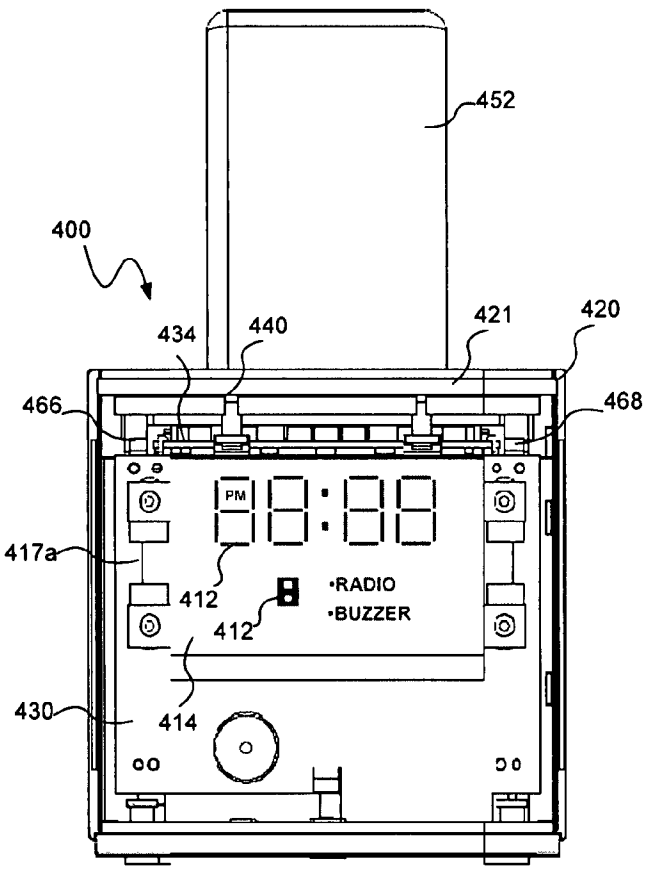
FIG. 9 is a front view of the clock audio apparatus taken along line 9-9 in FIG. 8 with the front display panel removed.

As shown in FIG. 8, the springs 418*a*-418*d* allow the LED display element carriage 414 to move (e.g., in the direction of arrow 405) when the display panel 422 is secured to the housing 420 and against the LED display element carriage 414. After the display panel 422 is secured to the housing 420, the springs 418*a*-418*d* apply a force against the LED display element carriage 414 such that the LED display element carriage 414 is biased into contact with the inside surface 426 of the display panel 422. The display panel 422 may be secured to the housing 420 mechanically (e.g., screw fasteners) or by ultrasonic welding. Using either method, the display panel 422 is mechanically affixed to the housing 420 such that there is no movement between the panel 422 and the housing 420.

In the illustrated embodiment, display holders 417*a*, 417*b* are used to hold the LED display element carriage 414 to a structure within the housing 420. For example, the display holders 417*a*, 417*b* may be mounted to a circuit board such as LED circuit board 430. The display holders 417*a*, 417*b* may include posts 419*a*-419*d* that receive screws or other fasteners (not shown) extending through holes 415*a*-415*d* in the LED display element carriage 414. The springs 418*a*-418*d* may be positioned around the posts 419*a*-419*d* such that the springs 418*a*-418*d* allow the LED display element carriage 414 to float (e.g., in the direction of arrow 405 in FIG. 8) when secured to the display holders 417*a*, 417*b*. Other types of mechanisms may also be used to secure and bias the light emitting elements 412 into contact with the display panel 422.

The control circuitry 430, 432, 434 may include, for example, LED circuit board 430, main circuit board 432, and interface circuit board 434 mounted within the housing 420. The LED circuit board 430 may be coupled to the LEDs 412 and may include display driver circuitry known to those skilled in the art for controlling illumination of the LEDs 412. The interface circuit board 434 may be coupled to the user interface controls 440, 442, 444, 446 and may include circuitry known to those skilled in the art for generating user interface signals in response to user activation of the interface controls 440, 442, 444, 446. The interface circuit board 434 may also be coupled to digital media player interface connector 454 and may include digital media player interface circuitry known to those skilled in the art for receiving digital signals from digital media players. The main circuit board 432 may be coupled to the LED circuit board 430 and the user interface circuit board 434 and may include circuitry known to those skilled in the art for controlling display, clock and audio functions. Other configurations of circuit boards may also be used to implement the control circuitry for controlling the functions of the clock audio apparatus.

The user interface controls 440, 442, 444, 446 may be located on a top panel of the housing 420 and coupled to the interface circuit board 434. The user interface controls 440, 442, 444, 446 may include, for example, one or more buttons, keys or switches for turning power on/off, for selecting an audio input, for controlling volume, for selecting audio tracks and/or radio stations, for turning on alarms, for activating snooze features, for activating sleep features, for changing modes, for controlling the brightness of the display, and for setting the clock and alarm times.

The digital media player dock 450 may be located on a top panel of the housing 420 for receiving a digital media player 452 such as an IPOD® digital media player. The digital media player dock 450 may include a digital media player interface connector 454 configured to connect the digital media player 452 to the clock audio apparatus 400 such that digital media on the digital media player 452 may be played through the clock audio apparatus 400. Other types of connectors 454 may also be used for connection to other types of digital media devices.

The speaker components 460, 462, 464 may be located on sides of the housing 420 and coupled to the main circuit board 432 to receive audio signals. The speaker components may include different size side speakers 460, 462 such as high frequency and low frequency speakers and a speaker port 464. The speakers 460, 462 may be enclosed by speaker enclosures 466, 468. The speaker enclosures 466, 468 may define the tunnel forming the speaker port 464, thus allowing the speaker components 460, 462, 464 to fit within a limited space in the housing 420. The speaker enclosures 466, 468 may also provide a frame that holds the other components (e.g., circuit boards 430, 432, 434) together within the apparatus 400. Other types and configurations of speakers known to those skilled in the art may also be used.

Although a specific shape, design and configuration of the clock audio apparatus 400 is shown, other shapes, designs and configurations are contemplated. Hidden displays, as described herein, may also be used in other types of devices, such as clocks without audio functions, audio devices without clocks, other electronic devices, and appliances.

Accordingly, the hidden display, consistent with the embodiments described herein, may provide a clear illumination of information on an outside surface of an apparatus without the display hardware being visible to the naked eye from the outside of the apparatus.

Consistent with one embodiment, a hidden display includes at least one light emitting display element and a display panel having an inside surface and an outside surface. The inside surface of the display panel is in contact with the at least one light emitting display element such that light emitted from the light emitting display element is optically coupled into the display panel. The outside surface of the display panel includes a display region for displaying illuminated information formed by the light optically coupled into the display panel. The display panel is transparent to at least a portion of the light from the light emitting display element optically coupled into the display panel such that the light from the light emitting display element is visible on the outside surface as the illuminated information. The display is opaque to ambient light impinging upon the outside surface such that the light emitting display element is not visible behind the outside surface when the light emitting element does not emit light. The outside surface provides a diffuse reflection of ambient light.

Consistent with another embodiment, an apparatus includes a housing, display driver circuitry, and a hidden display integral with at least one side of the housing. The hidden display includes at least one light emitting display element and a display panel having an inside surface and an outside surface. The inside surface of the display panel is in contact with the at least one light emitting display element such that light emitted from the light emitting display element is optically coupled into the display panel. The outside surface of the display panel includes a display region for displaying illuminated information formed by the light optically coupled into the display panel. The display panel is transparent to at least a portion of the light from the light emitting display element optically coupled into the display panel such that the light from the light emitting display element is visible on the outside surface as the illuminated information. The display is opaque to ambient light impinging upon the outside surface such that the light emitting display element is not visible behind the outside surface when the light emitting element does not emit light. The outside surface provides a diffuse reflection of ambient light.

Consistent with a further embodiment, a clock includes a housing, control circuitry located within the housing configured to control at least clock functions and display functions, and a hidden display integral with at least one side of the housing. The hidden display includes at least one light emitting display element and a display panel having an inside surface and an outside surface. The inside surface of the display panel is in contact with the at least one light emitting display element such that light emitted from the light emitting display element is optically coupled into the display panel. The outside surface of the display panel includes a display region for displaying illuminated information formed by the light optically coupled into the display panel. The display panel is transparent to at least a portion of the light from the light emitting display element optically coupled into the display panel such that the light from the light emitting display element is visible on the outside surface as the illuminated information. The display is opaque to ambient light impinging upon the outside surface such that the light emitting display element is not visible behind the outside surface when the light emitting element does not emit light. The outside surface provides a diffuse reflection of ambient light.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A hidden display comprising:

at least one light emitting display element; and a display panel having an inside surface and an outside surface, the inside surface of the display panel being in contact with the at least one light emitting display element such that light emitted from the light emitting display element is optically coupled into the display panel, the outside surface of the display panel including a display region for displaying illuminated information formed by the light optically coupled into the display panel, wherein the display panel is transparent to at least a portion of the light from the light emitting display element optically coupled into the display panel such that the light from the light emitting display element is visible on the outside surface as the illuminated information, and wherein the display is opaque to ambient light impinging upon the outside surface such that the light emitting display element is not visible behind the outside surface when the light emitting element does not emit light, and wherein the outside surface provides a diffuse reflection of ambient light such that a substantial portion of ambient light is reflected without creating a mirror-like effect.

2. The hidden display of claim 1 further comprising a spring biasing mechanism biasing the at least one light emitting display element into contact with the inside surface of the display panel.

3. The hidden display of claim 2 further comprising a display element carriage carrying the at least one light emitting display element, and wherein the spring biasing mechanism engages the display element carriage to bias the at least one light emitting display element into contact with the inside surface of the display panel.

4. The hidden display of claim 2 wherein the spring biasing mechanism includes at least one compression spring.

5. The hidden display of claim 4 further comprising a display element carriage, and wherein the at least one light emitting display element includes a plurality of light emitting diodes (LEDs) carried by the display element carriage, and wherein the biasing mechanism includes at least four compression springs engaging the display element carriage.

6. The hidden display of claim 1 wherein the at least one light emitting display element includes at least one light emitting diode (LED).

7. The hidden display of claim 1 wherein the at least one light emitting display element includes a segmented display.

8. The hidden display of claim 7 wherein the segmented display includes a plurality of light emitting diode (LED) segments.

9. The hidden display of claim 1 wherein the display panel includes a transparent substrate with a coating forming the inside surface.

10. The hidden display of claim 1 wherein the display panel includes at least a polycarbonate substrate powder coated on the inside surface.

11. The hidden display of claim 10 wherein the polycarbonate substrate includes a textured finish on the outside surface.

12. An apparatus comprising:

a housing;

display driver circuitry; and a hidden display integral with at least one side of the housing, the hidden display comprising:

at least one light emitting display element; and a display panel having an inside surface and an outside surface, the inside surface of the display panel being in contact with the at least one light emitting display element such that light emitted from the light emitting display element is optically coupled into the display panel, the outside surface of the display panel including a display region for displaying illuminated information formed by the light optically coupled into the display panel, wherein the display panel is transparent to at least a portion of the light from the light emitting display element optically coupled into the display panel such that the light from the light emitting display element is visible on the outside surface as the illuminated information, and wherein the display is opaque to ambient light impinging upon the outside surface such that the light emitting display element is not visible behind the outside surface when the light emitting element does not emit light, and wherein the outside surface provides a diffuse reflection of ambient light such that a substantial portion of ambient light is reflected without creating a mirror-like effect.

13. The apparatus of claim 12 wherein the at least one light emitting display element includes at least one light emitting diode (LED).

14. The apparatus of claim 12 further comprising a seal between the display panel and the housing to prevent light from the light emitting display element from passing out of the housing between the display panel and the housing.

15. The apparatus of claim 12 further comprising at least one circuit board mounted within the housing proximate the display panel, wherein the circuit board includes at least the display driver circuitry, and wherein the light emitting display element is secured to the circuit board.

16. The apparatus of claim 15 further comprising a spring biasing mechanism between the circuit board and the light emitting display element, wherein the biasing mechanism biases the light emitting display element into contact with the display panel.

17. The apparatus of claim 14 wherein the display panel includes a polycarbonate substrate with a powder coated inside surface and a textured finish on the outside surface.

18. A clock comprising:

a housing;

control circuitry located within the housing configured to control at least clock functions and display functions; and a hidden display integral with at least one side of the housing, the hidden display comprising: at least one light emitting display element; and a display panel having an inside surface and an outside surface, the inside surface of the display panel being in contact with the at least one light emitting display element such that light emitted from the light emitting display element is optically coupled into the display panel, the outside surface of the display panel including a display region for displaying illuminated information formed by the light optically coupled into the display panel, wherein the display panel is transparent to at least a portion of the light from the light emitting display element optically coupled into the display panel such that the light from the light emitting display element is visible on the outside surface as the illuminated information, and wherein the display is opaque to ambient light impinging upon the outside surface such that the light emitting display element is not visible behind the outside surface when the light emitting element does not emit light, and wherein the outside surface provides a diffuse reflection of ambient light such that a substantial portion of ambient light is reflected without creating a mirror-like effect.

19. The clock of claim 18 further comprising at least one speaker, and wherein the control circuitry is configured to control audio functions.

20. The clock of claim 18 further comprising:

at least one circuit board mounted within the housing proximate the display panel;

a display element carriage including a segmented LED display, wherein the display element carriage is secured to the circuit board; and a spring biasing mechanism between the circuit board and the display element carriage, wherein the biasing mechanism biases the segmented LED display into contact with the display panel.

* * * * *